US009806431B1

(12) United States Patent
Izadian

(10) Patent No.: US 9,806,431 B1
(45) Date of Patent: Oct. 31, 2017

(54) SLOTTED WAVEGUIDE ARRAY ANTENNA USING PRINTED WAVEGUIDE TRANSMISSION LINES

(71) Applicant: Waymo LLC, Mountain View, CA (US)

(72) Inventor: Jamal Izadian, San Jose, CA (US)

(73) Assignee: Waymo LLC, Mountain View, CA (US)

( * ) Notice: Subject to any disclaimer, the term of this patent is extended or adjusted under 35 U.S.C. 154(b) by 618 days.

(21) Appl. No.: 13/855,069

(22) Filed: Apr. 2, 2013

(51) Int. Cl.
*H01Q 21/00* (2006.01)
*H01Q 13/10* (2006.01)
*H01P 11/00* (2006.01)

(52) U.S. Cl.
CPC ..... *H01Q 21/005* (2013.01); *H01Q 13/10* (2013.01); *H01P 11/00* (2013.01)

(58) Field of Classification Search
CPC ..... H01Q 21/005
See application file for complete search history.

(56) References Cited

U.S. PATENT DOCUMENTS 3,854,083 A 12/1974 Hulderman et al.
4,918,411 A 4/1990 Staehlin et al.
5,726,666 A * 3/1998 Hoover ..... H01Q 13/22 343/767
5,977,924 A 11/1999 Takei
5,982,256 A 11/1999 Uchimura et al.
6,285,335 B1 * 9/2001 Snygg ..... H01Q 21/0087 343/770
6,351,244 B1 * 2/2002 Snygg ..... H01Q 1/246 343/770
6,535,173 B2 * 3/2003 Ou ..... H01Q 21/064 343/770
6,822,534 B2 11/2004 Uriu
(Continued)

FOREIGN PATENT DOCUMENTS

JP 2001156510 6/2001
WO 2009023551 2/2009

OTHER PUBLICATIONS

Non-Final Office Action issued in co-pending U.S. Appl. No. 13/852,416, U.S. Patent and Trademark Office, dated Jan. 14, 2015, 14 pages.

(Continued)

*Primary Examiner* — Robert Karacsony
(74) *Attorney, Agent, or Firm* — McDonnell Boehnen Hulbert & Berghoff LLP

(57) ABSTRACT

Example methods and systems for implementing slotted waveguide array antenna using printed waveguide transmission lines technology are described herein. One example method may include developing a slotted waveguide array antenna may be developed using a plurality of slotted waveguides aligned in an antenna array, in which each slotted waveguide may be developed using printed waveguide transmission lines technology. Components of the slotted waveguide array antenna may be developed using printed circuit board materials, such as Kapton-type laminate and FR4. In addition, through using printed waveguide transmission line technology, a slotted waveguide array antenna may be configured to radiate millimeter electromagnetic waves and may be configured to operate in radar, navigation, or other high frequency systems.

6 Claims, 6 Drawing Sheets

(56) References Cited

U.S. PATENT DOCUMENTS

| | | | | |
|---|---|---|---|---|
| 6,972,727 | B1 * | 12/2005 | West | H01P 1/181 333/157 |
| 7,215,007 | B2 | 5/2007 | McKinzie, III | |
| 7,227,428 | B2 | 6/2007 | Fukunaga | |
| 8,040,286 | B2 | 10/2011 | Matsuo | |
| 8,188,805 | B2 | 5/2012 | Nomura | |
| 8,212,580 | B2 | 7/2012 | Izadian | |
| 2006/0226931 | A1 | 10/2006 | Tavassoli Hozouri | |
| 2007/0262828 | A1 | 11/2007 | Fujita | |
| 2008/0150821 | A1 | 6/2008 | Koch | |
| 2008/0169349 | A1 | 7/2008 | Suzuki | |
| 2010/0307798 | A1 | 12/2010 | Izadian | |
| 2011/0001584 | A1 | 1/2011 | Enokihara | |
| 2011/0018657 | A1 | 1/2011 | Cheng | |
| 2012/0050125 | A1 | 3/2012 | Leiba | |
| 2012/0056776 | A1 | 3/2012 | Shijo | |
| 2012/0287006 | A1 * | 11/2012 | Lenormand | H01Q 1/3275 343/771 |
| 2012/0306598 | A1 | 12/2012 | Izadian | |

OTHER PUBLICATIONS

Non-Final Office Action issued in co-pending U.S. Appl. No. 13/854,190, U.S. Patent and Trademark Office, dated Dec. 29, 2014, 16 pages.

Non-Final Office Action issued in co-pending U.S. Appl. No. 13/851,469, U.S. Patent and Trademark Office, dated Jan. 20, 2015, 14 pages.

* cited by examiner

SLOTTED WAVEGUIDE ARRAY ANTENNA USING PRINTED WAVEGUIDE TRANSMISSION LINES

BACKGROUND

In communications and electronic engineering, antennas are used for the conversion between electrical power and radio waves. During transmission, a radio transmitter may supply an oscillating radio frequency electric current to an antenna's terminals to cause the antenna to radiate the energy as electromagnetic waves. During reception, an antenna may intercept some of the power of electromagnetic waves in order to produce a small voltage at the terminals of the antenna. The small voltage is applied to a receiver to be amplified. Antennas may be used in systems such as radio broadcasting, broadcast television, two-way radio, communications receivers, radar, cell phones, and satellite communications, as well as other devices such as garage door openers, wireless microphones, Bluetooth devices, and wireless computer networks, etc. Antennas exist in different sizes and models depending on the purpose of the antenna.

SUMMARY

The present application discloses embodiments that relate to the implementation of a slotted waveguide array antenna using printed waveguide transmission lines. In one aspect, the present application describes a method. The method may comprise forming an antenna array including a plurality of radiating waveguides that comprise a plurality of layers including at least a first layer and a second layer. The first layer includes a first conducting layer coupled to a first dielectric layer and the first conducting layer includes at least one radiating aperture, and the first dielectric layer includes a first waveguide channel. The second layer is coupled to the first layer and includes a second dielectric layer coupled between a second conducting layer and a third conducting layer and the second conducting layer includes at least one radiating aperture and the second dielectric layer includes a second waveguide channel. The at least one radiating aperture of the second conducting layer is substantially aligned and/or offset at least in part with the second waveguide channel and the at least one radiating aperture of the first conducting layer is substantially aligned at least in part with the first waveguide channel. The method also may comprise a coupling at least one feed waveguide to the plurality radiating waveguides of the antenna array to feed the plurality of radiating waveguides. The at least one feed waveguide includes an input on an end extended away from the antenna array configured to receive input to feed the plurality of radiating waveguides.

In another aspect, the present application describes an apparatus. The apparatus may comprise an antenna array including a plurality of radiating waveguides that comprise a plurality of layers including at least a first layer and a second layer. The first layer includes a first conducting layer coupled to a first dielectric layer and the first conducting layer includes at least one radiating aperture, and the first dielectric layer includes a first waveguide channel. The second layer is coupled to the first layer and includes a second dielectric layer coupled between a second conducting layer and a third conducting layer and the second conducting layer includes at least one radiating aperture and the second dielectric layer includes a second waveguide channel. The at least one radiating aperture of the second conducting layer is substantially offset at least in part with the second waveguide channel and the at least one radiating aperture of the first conducting layer is substantially offset at least in part with the first waveguide channel. The apparatus also may comprise at least one feed waveguide coupled to the antenna array, and wherein the at least one feed waveguide is configured to feed the plurality of radiating waveguides. The at least one feed waveguide includes an input on an end extended away from the antenna array configured to receive input to feed the plurality of radiating waveguides.

In still another aspect, the present application includes another method. The method may comprise forming a first conducting layer including a plurality of radiating apertures, and forming a second conducting layer including a plurality of radiating apertures. The method also may comprise forming, between the first conducting layer and the second conducting layer, a first layer including a first waveguide channel. The plurality of radiating apertures of the first conducting layer and plurality of radiating apertures of the second conducting layer define a first electromagnetic waveguide path configured to transmit and receive electromagnetic waves to and from the first waveguide channel. The method also may comprise forming a third conducting layer. The method further may comprise forming, between the second conducting layer and the third conducting layer, a second layer including a second waveguide channel. The plurality of radiating apertures of the second conducting layer defines a second electromagnetic waveguide path configured to transmit and receive electromagnetic waves to and from the second waveguide channel.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

Figure 1:
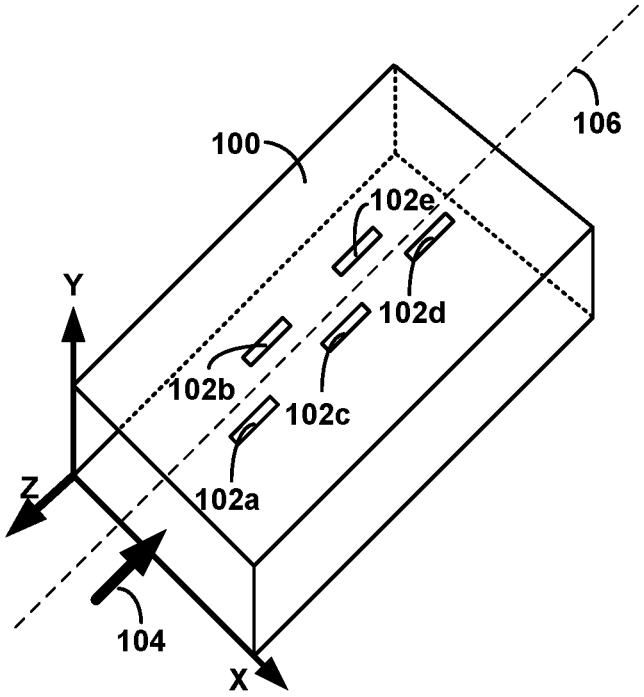
FIG. 1 illustrates an example waveguide that may be used within a slotted waveguide array antenna or other components.

The following detailed description describes various features and functions of the disclosed systems and methods with reference to the accompanying Figures. In the Figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

I. Overview

Wave motion transfer energy from one point to another, often with no permanent displacement of the particles of the medium. There are different types of waves, such as mechanical and electromagnetic. Mechanical waves propagate through a medium and may deform the substance of the medium that the wave traveled through. Electromagnetic waves do not require a medium and consist of period oscillations of electrical and magnetic fields generated by charged particles. Examples of electromagnetic waves include radio waves, microwaves, infrared radiation, visible light, ultra violate, radiation, X-rays, and gamma rays. Electromagnetic waves may vary in wavelength. In open space, waves may propagate in all directions as spherical waves that may lose power as the waves propagate through open space. The waves may lose power proportionally to the square of propagation distance; that is, at a distance R from the source, the power is the source power divided by $R^2$.

A system may use one or more waveguides, which are physical structures that may be used to guide waves, such as electromagnetic waves or sound waves. Under ideal conditions, a waveguide may direct and radiate a wave without causing that wave to lose any power while propagating.

Different types of waveguides are configured to guide waves with different wavelengths. For example, one type of waveguide may be a hollow conductive metal pipe that can be used to channel high frequency radio waves (e.g., microwaves). In addition to guiding different types of waves, some types of waveguides may radiate waves using a specific number of dimensions. For example, a waveguide may confine a wave to propagate using only one-dimension. Similarly, a waveguide may be configured to guide waves in two-dimensional and/or three-dimensional paths.

The geometry and/or composition of a waveguide may reflect the functions of the waveguide. A slab waveguide, for example, may confine waves to travel in one-dimension, while fiber or channel waveguides may confine energy to travel in two-dimensions. In an example implementation, the walls of a waveguide may reflect radiating waves so that waves propagate in a "zigzag" path between walls. For example, a hollow metal tube with a rectangular or circular cross-section may guide waves in a "zigzag" path.

The shape of a waveguide may also determine the possible frequencies of waves that are able to be guided within the waveguide. For example, an optical fiber may be able to guide light waves, but may not be able to guide microwaves that travel at a much lower frequency than light waves. Generally, the width of a waveguide may be of the same order of magnitude as a respective wavelength of the guided wave. Through guiding waves, waveguides may be used for transferring both power and communication signals. For example, waveguide transmission line technology may be used within radar systems, microwave ovens, satellite communications, high speed routers and cabling, and antenna systems. With regard to antenna systems, in particular, waveguide transmission lines enable electromagnetic waves such as radio frequency waves to be received at and transmitted from antennas.

In addition, waveguides can be constructed to guide waves that have varying wavelengths throughout a wide portion of the electromagnetic spectrum. For example, a waveguide may be configured to guide waves within the microwave and optical frequency ranges. Depending on the desired frequency range, waveguides may be constructed using conductive, dielectric materials or a combination of the materials and through various methods. For example, waveguides may be manufactured by machining solid blocks of metal with channels in which the radio waves may travel. Additionally or alternatively, waveguide transmission lines may be manufactured using high-quality dielectric laminates, such as high-quality radio frequency laminates for waveguide transmission lines used for radio wave communications. Such laminates may comprise conducting material (e.g., copper) electrodeposited in one or more surfaces of the laminate, and may further comprise additional conducting layers (e.g., copper, aluminum, and/or brass foils/plates). In addition, some waveguides or similar channels for transporting energy may be developed using sheet metals of various thicknesses, such as foils.

In some example constructions, waveguides may be developed through the use of printed waveguide transmission lines ("PWTLs") technology, which may include a multi-layer laminated structure including printed electronics, such as printed circuit boards ("PCBs") made up of a dielectric material with an conducting material imaged (i.e., "printed") and deposited in the dielectric material or other types of material. One example use of PWTL technology may include rectangular channels formed in the multi-layer structure and configured to transmit/propagate transverse electric ("$TE_{mn}$") waves, where m is a number of half-wavelengths across a width of the rectangular channel and n is the number of half-wavelengths across the height of the rectangular channel. In some implementations, creating slotted waveguides through using PWTL technology may require the application of additional materials, such as metals and foil stacks, in order to create waveguide channels within the slotted waveguides. Using PWTL technology may serve as a way to develop waveguides that are capable of guiding waves of various wavelengths, including those waves operating in the millimeter range. In addition, PWTL technology, among other waveguide technologies, may provide precision within waveguides for facilitating the propagation of radar wave signals in the radio frequency range (e.g., 77 GHz wave signals) with low energy/power losses, such as radiation loss, resistive loss, dielectric loss, or the like.

In general, slotted waveguides developed using PWTL technology (including, but not limited to, the range of frequencies supported by the PWTL and the reduction of losses by the PWTL) may result in an increase accuracy and precision of the slotted waveguide. PWTL may permit the configuration of waveguides that are one-dimensional, two-dimensional, three dimensional, or a degree between these dimensions (2.5-dimensional). Slotted waveguides using PWTL technology may enable waves to be guided in three-dimensions and/or radiated, for example.

In channeled waveguides created through PWTL, energy may travel through air resulting in zero dielectric losses. In this case, losses may be due to surface roughness and conductive losses of the wall, as well as the mechanism of multiple reflections from the walls of the waveguide. The closer a waveguide channel emulates a uniform conductivity around the cross section of the waveguide will result in the performance of the waveguide operating as an ideal rectangular waveguide.

The application of PWTL technology may be used to generate the waveguides and/or other components that are used to create a slotted waveguide array ("SWGA") antenna. In general, a SWGA antenna may be used for radar, navigation, or other high-frequency systems, partially due to a SWGA antenna's ability to operate at a high efficiency, and radiate linear polarization with low cross-polarization. A SWGA antenna may be configured to radiate electromagnetic fields into space efficiently through the radiating apertures or through-holes of the slotted waveguides in the antenna array. Radiating apertures are interchangeable terms with regards to slotted waveguides. Thus, a SWGA antenna may be developed through the use of PWTL technology allowing the SWGA antenna to operate efficiently with precision and accuracy, even at millimeter wave regions (e.g., 20 GHz-200 GHZ). In some implementations, PWTL technology may be used to provide structure or function to an SWGA antenna to lower costs and improve the overall functions of the slotted waveguides within the SWGA antenna. One or more components of an SWGA antenna may be developed using PWTL technology.

Referring to the Figures, FIG. 1 illustrates an example slotted waveguide 100 that may be used within a SWGA antenna. In order to implement a SWGA antenna, the development and use of slotted waveguides may be necessary.

In order to function, a SWGA antenna may be configured using one or more of slotted waveguides, such as the example slotted waveguide 100 illustrated in FIG. 1. FIG. 1 depicts the slotted waveguide 100 as a hollow, rectangular waveguide, but in other examples, the slotted waveguide may be different shapes and may also vary in size and length.

FIG. 1 illustrates the example slotted waveguide 100 as extending in length along the z-axis, extending in width along the x-axis, and extending in height along the y-axis. In other examples, the slotted waveguide 100 may extend different lengths and/or proportions relative to the other axis. In addition, the example slotted waveguide 100 shown within FIG. 1 includes an open face of the slotted waveguide 100 that exists at the plane of the waveguide that are created by the x-axis and y-axis (at z=0). In other examples, the slotted waveguide may include openings at different planes.

The example slotted waveguide 100 shown in FIG. 1 includes multiple radiating apertures (radiating apertures 102*a*-102*e*). In some instances, the slotted waveguide 100 may include more or less radiating apertures and/or through-holes. During the development of a slotted waveguide, radiating apertures placed on one or more surfaces of the slotted waveguide may be classified by shape, location on the waveguide, and the overall array of the radiating apertures.

Although FIG. 1 depicts the radiating apertures 102*a*-102*e* as rectangular slits on the top surface of the example slotted waveguide 100, radiating apertures and/or through-holes may vary in shape and location in other examples. In the example shown by FIG. 1 the radiating apertures 102*a*-102*e* are shown as thin slits, that may be, for example, less than 0.1 of a wavelength wide and 0.5 wavelengths long (at the center frequency of operation). In addition, the radiating apertures can be offset from the center line 106 of the waveguide 100. In some examples, the radiating apertures may be inclined in alternative directions along the length of a waveguide, or a combination of different layouts or positions. For example, the radiating aperture may be configured at various spacing at approximately a half waveguide.

Further, the radiating apertures and/or through-holes may be positioned in different ways along different surfaces of a slotted waveguide. In fact, the spacing of the radiating apertures and/or through-holes may be critical for the functions of the slotted waveguide, including the antenna functions. For example, a slotted waveguide may be configured with radiating apertures that are spaced using a multiple of the wavelength of the waveguide or half waveguide in order to effect the transmission and reception of the slotted waveguide. In addition, the spacing of the radiating apertures and/or through-holes may affect the gain of the slotted waveguide as an antenna. The radiating apertures on a slotted waveguide allow the waveguide to transmit energy using horizontal and/or vertical polarization depending on the orientation of the antenna to the ground, which is useful for distance transmission. For example, a waveguide operating in a horizontal orientation may be useful for long distance transmission. In some examples, the radiating apertures and/or through-holes may be positioned to allow vertical and/or horizontal polarization, for example. Other types of waveguide transmission may exist as well.

FIG. 1 depicts the radiating apertures 102*a*-102*e* as aligned in a parallel formation that consists of two rows offset alternatively from the centerline 106 of the waveguide 100. In other examples, the radiating apertures of a slotted waveguide may be angled, inclined, unaligned, aligned or offset in different directions according to various axes, or other layouts. The slotted waveguide 100 may act as a transmission line, and the radiating apertures in the waveguide may be viewed as parallel (shunt) admittances. The layout of the radiating apertures 102*a*-102*e* in FIG. 1 serves merely as an example illustration. In some implementations, the channels of a waveguide may be positioned on the narrow side of the waveguide. The slots may be located on the short edges of the waveguide or other positions, for example.

FIG. 1 also depicts arrow 104, which represents one of the possible paths that electromagnetic waves may enter the slotted waveguide 100. In the example, waves within the designated wavelength that slotted waveguide 100 may propagate, may enter the open plane of slotted waveguide 100 and propagate of the walls of the waveguide as guided. The other end opposite of the open end of the slotted waveguide is usually enclosed in metal creating a short within the waveguide or may be matched to a load in the case of a waveguide used for a traveling purpose. Furthermore, in another implementation, waveguides may be fed through slot coupling from a feed waveguide in series feed or other possible feed configurations.

In some implementations, the slotted waveguide 100 may be excited by a short dipole, or by another waveguide, for example. The slotted waveguide 100 may guide waves in a specific number of dimensions, such as two-dimensions, for example. Energy may be radiated through the radiating apertures as the wave energy travels through slotted waveguide 100. The slotted waveguide may direct the energy exiting through the radiating apertures through the positioning of the radiating apertures.

In other examples, the arrow 104 may represent waves entering the slotted waveguide 100 through different openings. While guiding waves, the slotted waveguide 100 may radiate waves through one opening to the other opening, bouncing the waves along the walls of the waveguide.

II. Example Fabrication Methods

Using one or more slotted waveguides, such as the example slotted waveguide shown in FIG. 1, a SWGA antenna may be manufactured for use in navigation, radar, or other high-frequency systems. In order to create an SWGA antenna, various techniques may be used, such as brazing or chemical etching. Other techniques may include ordinary PCB photolithographic processes or a combination of the various techniques.

Brazing is a metal joining process that involves heating a filler metal above the melting point and distributing the filler metal between two or more close-flitting parts by capillary action. Examples of brazing may include various types of brazing, including vacuum brazing. In vacuum brazing, the brazing may not require an immersion in molten metals, but may deposit the adhesive metal through spotting or electrolytic process. In some implementations, pressure and heat may be applied to achieve adhesion. The filler metal is melted at liquidus temperature and flows over the base metal through wetting and cooled to join the pieces together. Brazing may be used to create slotted wave guide array antennas at radio frequencies and microwave frequencies.

However, in order to produce a SWGA antenna that functions at smaller wave regions, including at millimeter wave regions (e.g., 77 GHz), a method may use PWTL technology to develop waveguides and/or other components to generate a SWGA antenna capable of functioning at millimeter wave regions. For example, an SWGA implemented using PWTL technology may be configured to operate within the 20 GHz-200 GHz region. In some example implementations of SWGA antennas, various components may be designed and fabricated separately, and then assembled to form the SWGA antenna. Performance of the SWGA antenna may depend on the accuracy of manufacturing of these components as described above.

Figure 2:
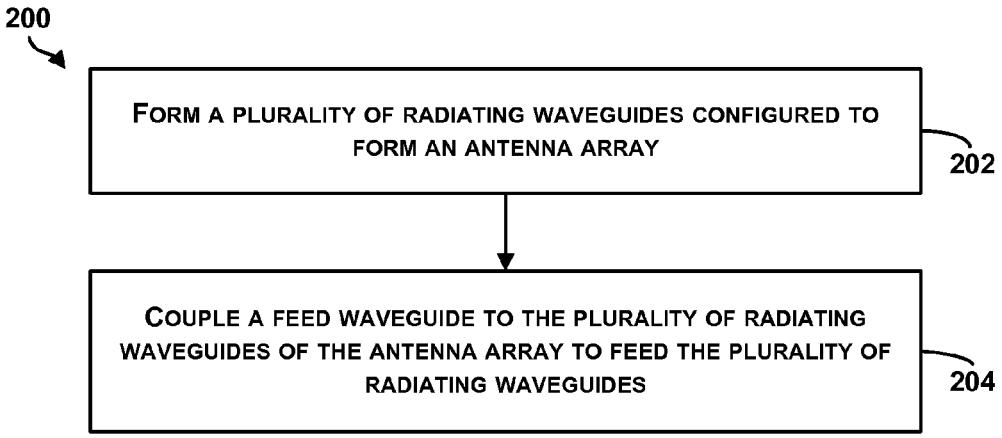
FIG. 2 is a flow chart of an example method for implementing a slotted waveguide array antenna using printed waveguide transmission lines.

FIG. 2 is a flow chart of a method 200 to form an example SWGA antenna using PWTL. The method 200 may provide an alternative manufacturing method of SWGA antennas or any other components involving waveguides configured for transmission radiation, and controlling electromagnetic waves.

The method 200 may include one or more operations, functions, or actions as illustrated by one or more of blocks 202-204. Although the blocks are illustrated in a sequential order, these blocks may, in some instances, be performed in parallel, and/or in a different order than those described herein. Also, the various blocks may be combined into fewer blocks, divided into additional blocks, and/or removed based upon the desired implementation.

At block 202, the method 200 includes forming a plurality of radiating waveguides configured to form an antenna array. The plurality of radiating waveguide may vary in types of waveguide used to form the antenna array. For example, the antenna array may include a number of the slotted waveguide shown in FIG. 1.

Each radiating waveguide may include one or more radiating apertures (slots) and/or through-holes, arranged in various ways as previously discussed. In some examples, the radiating waveguides may not contain any radiating apertures. In addition, the slotted waveguides may contain a number of layers including at least a first layer and a second layer. The first layer may include a first conducting layer coupled to a first dielectric layer and may include at least one radiating aperture. The second layer may be coupled to the first layer and may include a second dielectric layer coupled between a second conducting layer and a third conducting layer. In some instances, the second layer may include at least one radiating aperture substantially aligned and/or offset at least in part with the at least one radiating aperture of the first layer. In addition, the first layer and the second layer may include waveguide channels to guide waves. For example, the first layer may include a first waveguide channel and the second layer may include a second waveguide channel. The waveguide channels may be at least partially aligned or offset in some examples. In addition, the waveguide channels may be at least partially aligned and/or offset with the radiating apertures of the first and second layer. The waveguide channels within each slotted waveguide may guide the waves to the radiating apertures to radiate outward from the SWGA antenna. The waveguide channels may be structured in various ways in example SWGA antenna.

One possible implementation of structure that may be used to develop slotted waveguides using PWTL technology is further discussed in FIGS. 3A-3D. Other variations of developing slotted waveguides using PWTL technology may exist as well.

At block 204, the method 200 includes coupling a feed waveguide to the plurality of radiating waveguides of the antenna array to feed the plurality of radiating waveguides. In some examples, the feed waveguide may include an input on an end extended away from the antenna array configured to receive input to feed the plurality of radiating waveguides. Additionally, the feed waveguide may be a waveguide or other type of transmission line that may connect the antenna with the radio transmitter or receiver.

The feed waveguide may be aligned on the same plane as the array of slotted waveguides. In some examples, the feed waveguide may be coupled to each of the plurality of radiating waveguides. In other implementations, the feed waveguide may be coupled to only some of the plurality of slotted waveguides. The feed waveguide may be similar to the waveguides used in the array of the SWGA antenna, or may be created using to have different form or functions. An SWGA antenna implemented using PWTL may be configured to operate using a series or parallel feed. Similarly, in some instances, the SWGA antenna may be configured with a hybrid feed mechanism. The feed waveguide discussed above serves merely as illustration purposes with other examples existing as well.

In some implementations, the feed waveguide may be coupled perpendicularly to the slotted waveguide array in an SWGA antenna. The feed waveguide may be connected in different ways as well. Furthermore, an SWGA antenna may include more than one feed waveguides, which may serve similar or different functions.

The feed waveguide may include a flange on one end, which is a connector for joining sections of waveguide. Similar to a pipe flange, the flange may have a connecting face that is square, circular, rectangular, or another shape. In some implementations, the feed waveguide and/or feed mechanism may be highly flexible. For example, the SWGA may be the top portion of a multilayer stack of other PWTL layers with other RF components as part of an integrated system, such as in a radar system. The SWGA may be fed through one or more lower layers, for example, from a RX port or a TX port, etc. The ports may be configured to provide the waveguides with energy in some implementations. Other examples for ports, flanges and feed waveguides may exist as well.

Referring to FIGS. 3A-3D, the Figures illustrate different structural layers that may be used in the development of waveguides or other components used to build a SWGA antenna. In order to develop the different layers, a method may use PWTL technology. In some examples, the radiating waveguides within the SWGA may be created using different materials and/or through using different technologies. For example, a radiating waveguide may include multiple layers with each layer containing different materials.

Figure 3A:
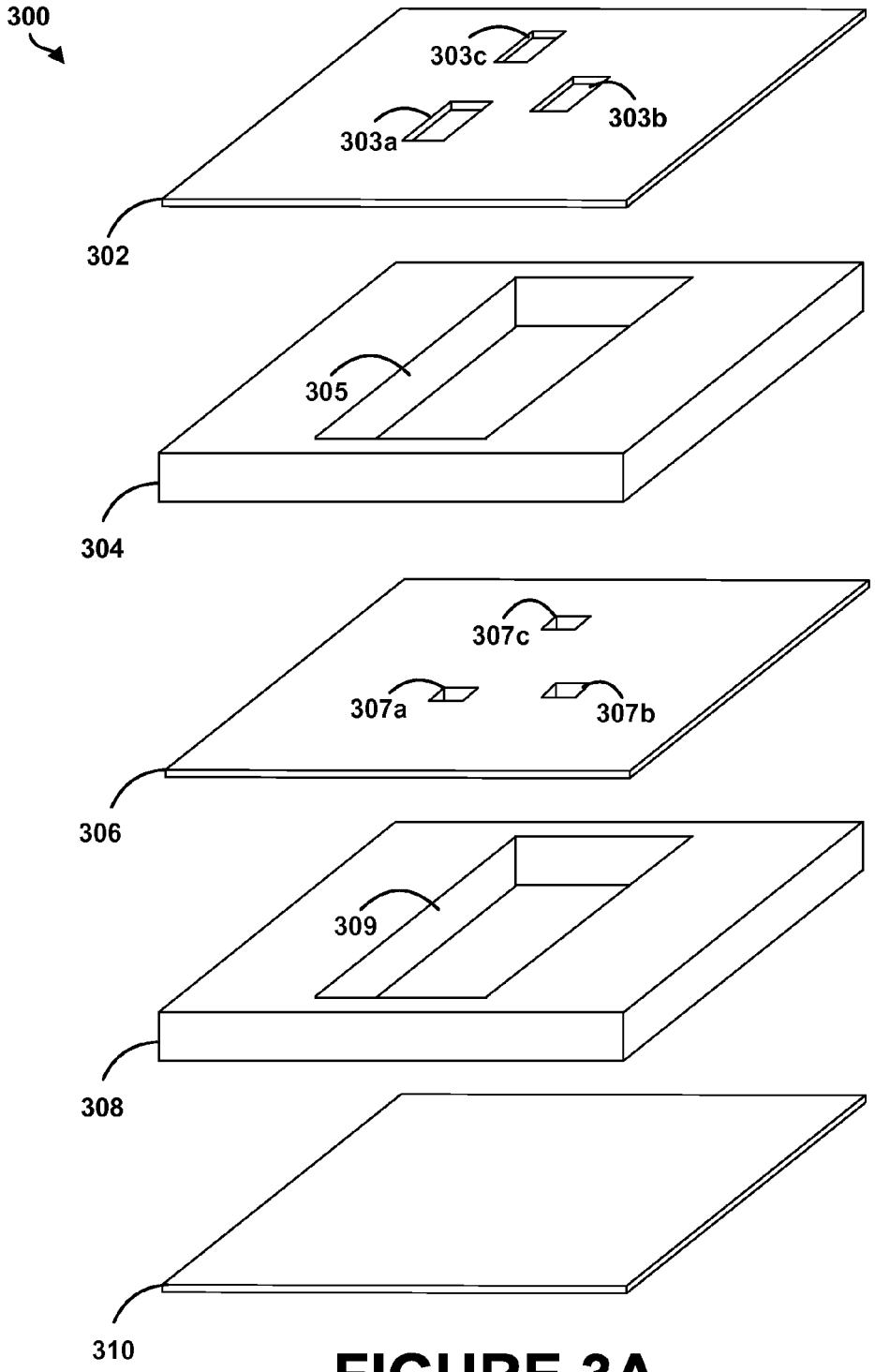
FIG. 3A illustrates an exploded view of different layers that may be used to construct an example apparatus that may be used to construct a slotted waveguide array antenna.

FIG. 3A illustrates an exploded view of different layers of an example apparatus 300, which may be used within the development of a SWGA antenna. For example, the structure and/or layout of the apparatus 300 may use to generate slotted waveguides, develop channels for transporting energy within a SWGA antenna, develop a feed wave guide, other portions of a SWGA antenna, or additional components.

As shown in FIG. 3A, apparatus 300 may be structured to include a first conducting layer 302, which may exist as a single conducting layer, multiple conducting layers, or a non-conducting layer coupled to a conducting layer, for example. Similarly, the first conducting layer 302 may be created as a partially conducting layer in some implementations.

The first conducting layer 302 may include a plurality of radiating apertures and/or through-holes such as radiating aperture 303*a*, radiating aperture 303*b*, and radiating aperture 303*c*. The three radiating apertures shown in FIG. 3A serve merely as one example and may include more or less radiating apertures in other examples. The radiating apertures may be drilled, etched, or formed using any other manufacturing technique appropriate for the material of the first conducting layer 302. Further, the size of the radiating apertures and/or through-holes may vary in some examples. Additionally, the layout of the radiating apertures and/or through-holes may differ depending on the purpose of the radiating apertures and/or through-holes. For example, the first conducting layer 302 may be a portion of a slotted waveguide functioning within a SWGA antenna and may require the radiating apertures and/or through-holes to be placed in a specific layout to allow the SWGA antenna to operate properly. Although FIG. 3A depicts a few radiating apertures, a lesser or greater number of radiating apertures and/or through-holes are possible as well. The radiating apertures shown within the first conducting layer 302 may correspond to the radiating apertures within a slotted waveguide that radiates energy. In some examples, the first conducting layer 302 may not contain any radiating apertures.

For development purposes, the first conducting layer 302 may include a combination of materials in some implementations, such as Kapton laminate that may be coupled to a conducting layer. In some forms, Kapton is a polyimide film that remains stable in a wide range of temperatures. In some instances, the Kapton-type layer that is coupled to the first conducting layer 302 may not have radiating apertures corresponding to the respective radiating apertures in the first conducting layer 302. During operation, the Kapton-type layer may be configured to radiate or propagate electromagnetic waves without radiating apertures due to the nature of the Kapton-type material, allowing it to be used within flexible printed circuits and waveguides. A Kapton-type layer or other flexible circuit board materials may function for other purposes as well within a SWGA.

Below the first conducting layer 302, FIG. 3A depicts that apparatus 300 may include a first layer 304 that may contain a waveguide channel for guiding waves, such as waveguide channel 305. In the example, the first layer 304 is positioned in between the first conducting layer 302 and an additional conducting layer, the second conducting layer 306. In other examples, the first layer 304 may be placed in a different position relative to the other layers shown within the example.

Similar to the first conducting layer 302, the example apparatus 300 shown in FIG. 3A may include a second conducting layer 306, which may include a plurality of radiating apertures, such as the radiating apertures 307*a*-307*c*. Like the first conducting layer 302, the second conducting layer 306 may be configured using various materials, such as foils or sheet metals. In some instances, thinner materials, such as PCB laminates (e.g., Kapton), may be used. The layers may be conducting or unable to conduct in different examples. In some implementations, the example second conducting layer 304 may include similar or the same materials as the first conducting layer 302, creating uniformity within apparatus 300. The second conducting layer 304 may include one or more layers of Kapton that may be laminated on one or both sides by copper laminate layers. In some implementations, the second conducting layer 304 may be configured as a medium for generating air filed waveguide channels. The second conducting layer 304 may be configured as a layer that does not conduct as well.

Additionally, the second conducting layer may be structured to include a number of radiating apertures, such as radiating aperture 307*a*, radiating aperture 307*b*, and radiating aperture 307*c*, along with other possible radiating apertures. Similar to the first conducting layer, the radiating apertures may be drilled, etched, or formed using any other manufacturing technique appropriate for the material of the second conducting layer 304. The size of the radiating apertures may vary in different examples, and may depend on the radiating apertures of the first conducting layer and/or the radiating apertures of the first layer 304.

During the development of apparatus 300, the plurality of radiating apertures of the first conducting layer 302, such as radiating aperture 303*a*, radiating aperture 303*b*, and radiating aperture 303*c*, may be aligned or offset at least partially with the plurality of radiating apertures of the lower layers, such as radiating aperture 307*a*, radiating aperture 307*b*, and radiating aperture 307*c* of the second conducting layer 304. In some example implementations, the radiating apertures may not overlap.

Referring back to the first layer 304 as shown in FIG. 3A, the first layer 304 is positioned between the first conducting layer 302 and the second conducting layer 306. The first layer 304 may include one or more waveguide channels and/or radiating apertures, such as the waveguide channel 305 shown in FIG. 3A. The waveguide channels and/or radiating apertures of the first layer 304 may be aligned or offset at least partially with the radiating apertures of the first conducting layer and/or the second conducting layer.

The waveguide channel 305 in the first layer 304 may be configured to guide waves through apparatus 300, allowing energy to radiate out the radiating apertures of the conducting layers, such as the radiating apertures of the first conducting layer 302. The channels may be different widths, sizes, or orientations in other examples. In addition, the channels, such as channel 305, may exist in larger or smaller numbers than shown in the example.

In some examples, the waveguide channels, radiating apertures of the various layers may be similar sizes or may have different sizes. In addition, the layout or shape of the radiating apertures and waveguide channels may vary from layer to layer. The layers may be reorganized in different positions, with additional or fewer layers included, for example. Further, a radiating aperture in a given layer may be of a similar size to respective radiating aperture of another layer, or may have different sizes. For instance, the radiating apertures, such as radiating aperture 303*a*, radiating aperture 303*b*, and radiating aperture 303*c*, of the first layer layer may have a smaller or larger size compared to the radiating aperture 307*a*, radiating aperture 307*b*, and radiating aperture 307*c* of the second conducting layer 306. The waveguide channels may vary in size and positioning between layers. The waveguide channels, radiating apertures of the second conducting layer 306 may be drilled, etched, or formed using any other manufacturing technique appropriate for conducting or developing a layer. Some layers may not include any radiating apertures or waveguide channels at all in some configurations.

Additionally, in some examples, the first layer 304 may be made of a conducting material, such as any metal (e.g., copper, aluminum, silver, etc.). The first layer 304 may be made of a dielectric material, such as FR4 or similar PCB materials that are laminated with conducting layers on either sides or another layout of dielectric and conducting materials.

In an example implementation, the first layer 304 may be created using FR4 material or a material with similar qualities, such as NELCO 4000. FR4 is a grade designation assigned to glass-reinforced epoxy laminate sheets, tubes, or rods and may include a composite material composed of woven fiberglass cloth with an epoxy resin binder that is flame resistant (self-extinguishing). FR4 glass epoxy is a versatile high-pressure thermoset plastic laminate grade that may be used as an electrical insulator due to its incredible mechanical strength. The FR4 material may be configured to retain high mechanical values and electrical insulating qualities in both dry and humid conditions. FR4 epoxy resin may include bromine, a halogen, to facilitate flame-resistant properties in FR4 glass epoxy laminates. The FR4 material may be laminated with conducting material coupled on both sides. PWTL may use FR4 to develop structure for air channels. In addition, FR4 may have metallization on top and bottom. When waveguide channels are created using FR4, the side walls of the channels are metalized to become effective conductors. The layers of the stack created using FR4 or similar materials may be thicker than the conducting layers, for example.

In the examples where the first layer 304 is made of FR4 material, inner surfaces of the radiating apertures or waveguide channels in the layer, such as the waveguide channel 305, may not be conducting surfaces, but may expose FR4 dielectric material. In these examples, a conducting material (e.g., a metallic material) may be deposited or plated on the inner surfaces of the waveguide channels or radiating apertures. The plated radiating apertures or plated waveguide channels, such as the waveguide channel 305, may be configured to provide conductive connections between layers, for example. Several techniques can be used to deposit or plate the inner surfaces of the radiating apertures or waveguide channels with a conducting material. The radiating apertures or waveguide channels may be preconditioned first. For example, several processes such as desemearing, hole-conditioning, micro-etching, activation, and acceleration can be applied to precondition the waveguide channels and/or radiating apertures. The first layer 304 may then be dipped in solution where electroless copper can be deposited on the inner surfaces. Other techniques can be used to deposit or plate a metallic or conducting material on the inner surfaces of the waveguide channels and/or radiating apertures. For instance, techniques used in printed circuit board manufacturing can be used for forming the first layer 304 and depositing a conducting material on respective inner surfaces of the waveguide channel 305. Other uses of the PWTL technology may be applied to the first layer 304 or the other layers additionally.

FIG. 3A, depicts a third conducting layer 310 that be made configured using a conducting material similar to respective materials of the first conducting layer 302 and the second conducting layer 304. The third conducting layer 310 can also be of a Kapton layer coupled to a conducting a laminate on one side of the Kapton layer. In some implementations, the third conducting layer 310 may be configured with coupling apertures that connect to other PWTL layers below the third conducting layer 310. The connection may include RX or TX ports of a Radar or other communication system, for example.

In addition, a second layer 308 may be formed between the second conducting layer 306 and the third conducting layer 310. The second layer 308 may have a waveguide channel 309 that may be aligned and/or offset at least partially with the waveguide 305 of the first layer 304. Further, respective radiating apertures or waveguide channels in the first conducting layer, the first layer, and the second conducting layer may define respective electromagnetic wave paths to and from the waveguide channels of the first layer and second layer. The waveguide channels and radiating apertures may be configured to allow waves to propagate in a predefined number of dimensions, including one-dimension, two-dimension, or three-dimensions.

As shown in the example illustration, the second layer 308 may be made of conducting material (e.g., a metallic material). For example, the second layer 308 may be generated using aluminum or copper sheet. Similar to the first layer, the second layer 308 may be made of FR4 material or similar materials such as NELCO 4000. In addition, the second layer 308 may be composed of other materials. The FR4 material, as described with respect to the first layer 304, may be laminated on both sides by a conducting (e.g., copper) laminate. In this example, however, the second waveguide channel may be formed in the second layer 308, inner surfaces of the waveguide channels are not metallic and expose FR4 dielectric or non-conducting material. In these examples, a conducting material (e.g., a metallic material) may be deposited or plated on the inner surfaces of the waveguide channel 309 of the second layer. As an example for illustration, after forming the waveguide channels, the second layer 308 may be dipped in solution where electroless copper can be deposited on the inner surfaces. As described with respect to the first layer 304, other techniques can be used to deposit or plate a metallic or conducting material on the inner surfaces of the radiating apertures or waveguide channels.

Figure 3B:
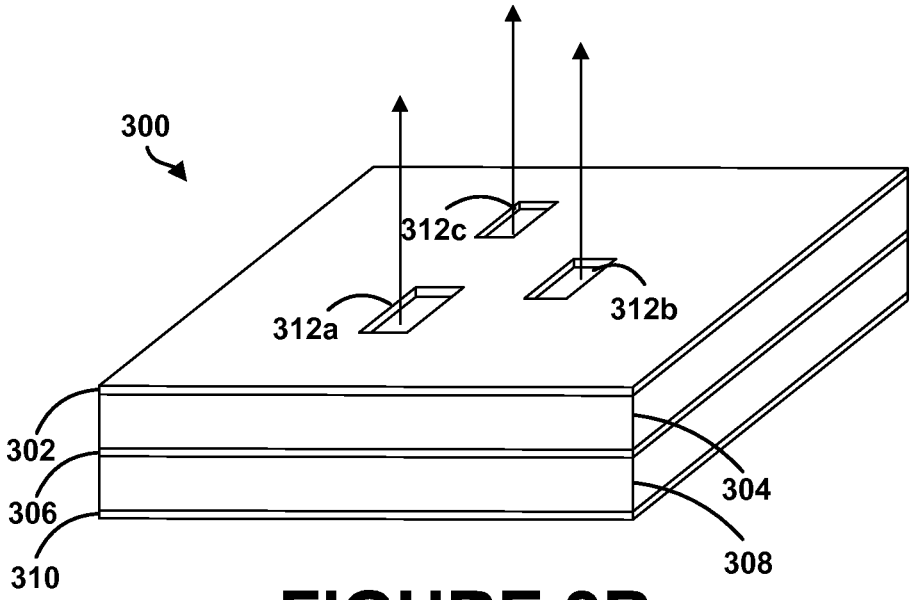
FIG. 3B illustrates an assembled view of the example apparatus.

In some examples, the copper laminate on both sides of the FR4 material or other materials can be utilized to form traces, similar to circuit-board traces, to implement electric circuitry and signal routing functionality. These traces may be formed using printing techniques implementing photolithography, for example FIG. 3B illustrates an assembled view of the apparatus 300, in accordance with an example embodiment. The apparatus 300 shown in FIGS. 3A and 3B may be configured to function as a slotted waveguide, another portion of a SWGA antenna, or another apparatus. For example, the radiating apertures of apparatus 300 may be configured to radiate energy from waves that are injected into the apparatus 300. The electromagnetic waves may be propagated through the radiating aperture 303A in the first conducting layer 302 and the radiating aperture 307A in the second conducting layer 306 to the waveguide channel 305 of the first layer 304.

In this manner, the at least partially aligned and/or offset radiating apertures in respective layers of the apparatus 300 may be configured to define electromagnetic wave paths. For example, the radiating apertures 303*a*, 307*a*, and waveguide channel 305 may be configured to define an electromagnetic wave path that receive transmit electromagnetic waves from and to the waveguide channel 309. Similarly, the radiating apertures and waveguide channels may be configured to define an electromagnetic wave path that receive transmits electromagnetic waves from and to the different waveguide channels and to radiate outside the slotted waveguides. Also, the radiating apertures may be configured to define an electromagnetic wave path that receive transmits electromagnetic waves from and to the waveguide channels. The structure of apparatus 300 may be used within SWGA antennas.

The radiating apertures may be repositioned on the first conducting layer 302 so that energy radiates outward from the apparatus 300 differently. For example, the radiating apertures may be positioned so that apparatus 300 functions as, at least part of, a slotted waveguide antenna. Multiple apparatuses similar to apparatus 300 may be lined up in parallel to create an array of slotted waveguides that function together as a SWGA antenna. The size and positioning of apparatus 300 servers merely as an example. Apparatus 300 may vary in size and may also be a portion of larger components. For example, apparatus 300 may only be the top surface of a rectangular-hallow slotted waveguide. The apparatus 300 shown in FIG. 3B may also be used to develop a feed waveguide that connects to the array of slotted waveguides within a SWGA antenna. The radiating apertures may define electromagnetic paths for the waveguide channels to receive and transmit waves.

III. Layer Construction Details

Figure 3C:
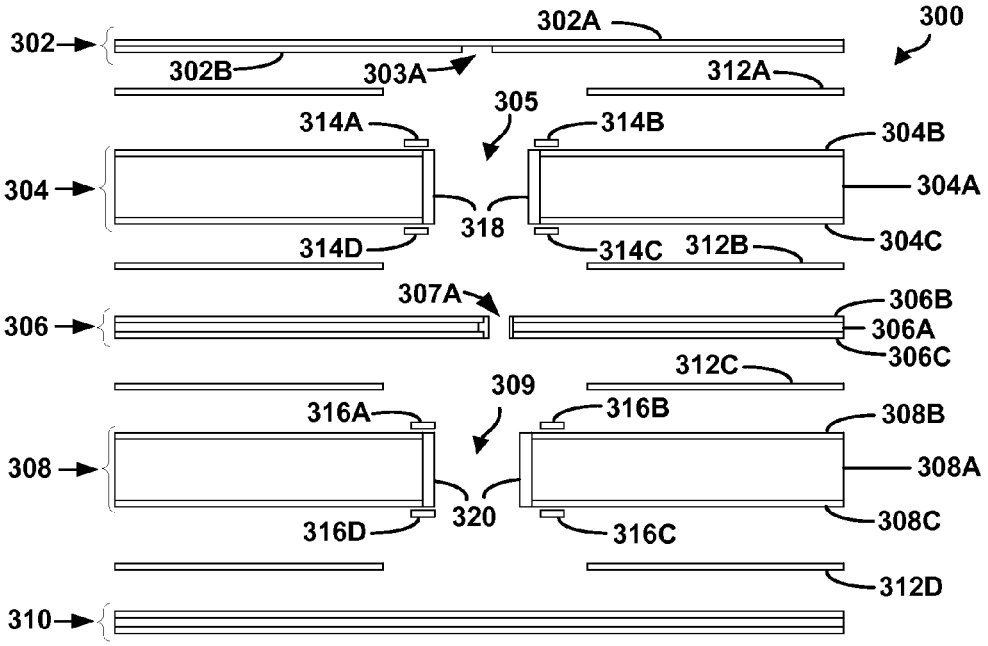
FIG. 3C illustrates an exploded view of a cross section of the example apparatus.

FIG. 3C illustrates an example exploded view of a cross section of the apparatus 300. FIG. 3C shows conducting layers, such as the first conducting layer 302, second conducting layer 306, and third conducting layer 310. In addition, FIG. 3C also depicts the first layer 304 and second layer 308.

Further, FIG. 3C depicts layer details not shown in the FIGS. 3A and 3B to further illustrate an example fabrication and characteristics of the apparatus 300. In examples, adhesive layers may be positioned between the respective layers to couple the respective layers together. For example, adhesive layer 312A can be positioned between the first conducting layer 302 and the first layer 304; adhesive layer 312B can be positioned between the first layer 304 and the second conducting layer 306; adhesive layer 312C can be positioned between the second conducting layer 306 and the second layer 308; and adhesive layer 312D can be positioned between the second layer 308 and the third conducting layer 310. In some examples, a subset of the adhesive layers 312A, 312B, 312C, and 312D may be used.

Instead of, or in addition to, the adhesive layers 312A, 312B, 312C, and 312D, localized solder paste can be used as an adhesive. For instance, in FIG. 3C, solder paste 314A, 314B, 314C, and 314D can be used to couple the first layer 304 to the first conducting 302 and the second conducting layer 306. Similarly, solder paste 316A, 316B, 316C, and 316D can be used to couple the second layer 308 to the second conducting layer 306 and the third conducting layer 310. Locations of the solder paste in FIG. 3C are examples for illustration only. Other locations and configurations can be used.

As described above, the first conducting layer 302 may be made of a conducting foil (e.g., a sheet of metal), or can be made of a Kapton layer coupled to a conducting layer (e.g., polyimide copper laminate). FIG. 3C depicts the latter configuration, where the first conducting layer 302 includes a Kapton layer 302A and a conducting layer 302B coupled to the Kapton layer 302A. Kapton is used herein as an example, and any other material can be used. Similarly, the second conducting layers 306 and the third conducting layer 310 may be made of a metallic sheet or foil, or may be made of Kapton layer coupled to conducting layers. For example, the second conducting layer may include a Kapton layer 304A coupled to or laminated with two conducting layers (e.g., copper laminates) 304B and 304C.

As described above, the first layer 304 and the second layer 308 may be made of conducting material (e.g., metallic material such as aluminum or copper), and in other examples, may be made of dielectric material coupled to conducting sheets or layers. FIG. 3C illustrates the latter examples. For example, the first layer 304 may be composed of a dielectric layer (FR4) 304A coupled to two conducting layers (e.g., sheets of copper laminates) 304B and 304C. Similarly, the second layer 308 may be composed of a dielectric layer (FR4) 308A coupled to two conducting layers (e.g., sheets of copper laminates) 308B and 308C. Electric circuitry and traces and may be formed on the two conducting layers (e.g., using photolithography) to implement electric circuits and associated functionality, for example.

In some examples, the first layer 304 and the second layer 308 may not be made of the same material. For example, the first layer 304 may be made of a conducting material such as aluminum, and the second layer 308 may be made of FR4 material coupled to two laminating conducting layers, or vice versa. Similarly, the first conducting layer 302 may be made of a material different from materials used for the second conducting material 306. For instance, the first conducting layer 302 may be made of a conducting material, while the second conducting material 306, or the third conducting layer 310, may be made of a Kapton layer coupled to two laminating conducting layers. Thus, different combinations of material can be used for the different layers of the apparatus 300.

In the example where dielectric material is used to form the first layer 304, forming the waveguide channel 305 may expose non conducting inner surfaces. In this example, a metallic plating or deposit 318 may be provided on respective inner surfaces of the waveguide channel 305 in the first layer 304. Similarly, in the example where a dielectric material is used to form the second layer 308, forming the second waveguide channel 309 in the second layer 308 may expose non conducting inner surfaces. In this example, a metallic plating or deposit 320 may be provided on respective inner surfaces the waveguide channel 309 in the second layer 308. Other radiating apertures and waveguide channels in the apparatus 300 can also be plated if respective layers are made of dielectric materials. The waveguide channel 305 and the waveguide channel 309 were described herein as examples illustrated in the FIG. 3C.

In some examples, the radiating apertures in the first conducting layer and the radiating apertures of the second conducting layer may define a first electromagnetic waveguide path configured to transmit and receive electromagnetic waves to and from the first waveguide channel in the first layer. Additionally, the radiating apertures in the second conducting layer may define a second electromagnetic waveguide path configured to transmit and receive electromagnetic waves to and from the second waveguide channel. Other combinations may exist as well. For example, the radiating apertures of the first conducting layer and the radiating apertures of the second conducting layer may be configured to define a waveguide path with the second waveguide channel. The first waveguide channel and second waveguide channel may transmit and receive waves from each other in some implementations.

Figure 3D:
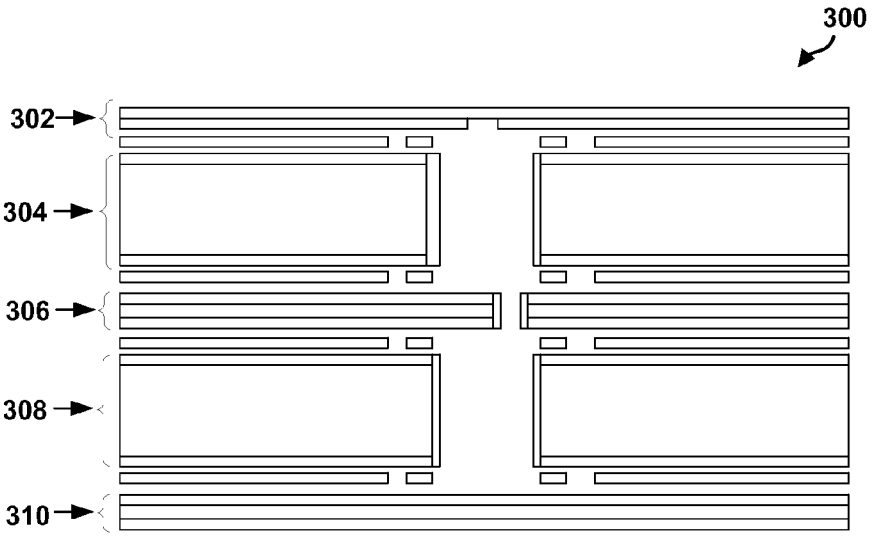
FIG. 3D illustrates an assembled view of the cross section of the example apparatus.

FIG. 3D illustrates an assembled view of the cross section of the apparatus 300, in accordance with an example embodiment. In some examples, pressure and/or heat can be applied to one or both of the outermost layers of the apparatus 300 (i.e., the first conducting layer 302 and the third conducting layer 310) to couple or bind the respective layers together using the adhesive layers 312A, 312B, 312C, and 312D, solder paste 314A, 314B, 314C, 314D, or solder paste 316A, 316B, 316C, 316D between the respective layers. In some examples, the adhesive layers 312A, 312B, 312C, and 312D may take the shape and size of the layers 302, 304, 306, 308, or 310. In other examples, the adhesive layers may take different shapes and sizes 312A, 312B, 312C, and 312D. In some implementations, the method of configuring adhesion to various layers of conductors or non-conductors in the lamination process may use various techniques. For example, all the adhesion may be configured within the PCB lamination process and/or may involve utilizing vacuum brazing and/or electrodepositing metallization adhesions. Other adhesive layers may be added within the stack or other layers.

In some examples, pressure and/or heat can be applied, by, for example, a plunger, on substantially an entire layer (e.g., the first conducting layer 302 and/or the third conducting layer 310) to couple the respective layers of the apparatus 300 together. The plunger, in these examples, may be referred to as a macro plunger. In other examples, an adhesive material or solder paste can be applied at discrete locations between the respective layers of the apparatus 300 as depicted by the solder paste 314A-314D or 316A-316D. In these examples, a plunger can be used to apply pressure at the discrete locations. In this case, the plunger may be referred to as a microplunger. The adhesive material can be any type of adhesive appropriate for the material of the respective layers of the apparatus 300. As an example, the adhesive can include polymerizable material that can be cured to bond the layers together. Curing involves the hardening of a polymer material by cross-linking of polymer chains, and curing may be, for example, brought about by chemical additives, ultraviolet radiation, electron beam, and/or heat. In an example, the polymerizable material may be made of a light-curable polymer material that can be cured using ultraviolet (UV) light or visible light. In addition to light curing, other methods of curing are possible as well, such as chemical additives and/or heat. Any other type of adhesive and bonding method can be used to couple the respective layers of the apparatus 300 together.

FIGS. 3C and 3D show that the radiating aperture 303A may at least partially be aligned and/or offset with the waveguide channel 305 and the radiating aperture 307A may at least partially be aligned and/or offset with the waveguide channel 305. The radiating apertures may be of different sizes. For example, the radiating aperture 307A may be of a different size compared to respective sizes of the radiating apertures 303A and waveguide channel 305. Having radiating apertures of different sizes as depicted may help in tuning resonance characteristics in the electromagnetic waves propagating through respective signal interconnections or paths defined by respective radiating apertures.

FIGS. 3A, 3B, 3C and 3D depict the third conducting layer 310 having no radiating apertures as an outermost layer of the apparatus 300. However, in other examples, the third conducting layer 310 may include radiating apertures similar to respective radiating apertures in the first conducting layer 302 and the second conducting layer 306. In the examples, other layers such as the first layer 304 and the second layer 308 may be coupled to the third conducting layer. The other layers may have respective waveguide channels and/or radiating apertures. Thus, by adding more layers to the apparatus 300, a complex network of 3D interconnections can be created to receive and transmit electromagnetic waves, which may be used within an SWGA antenna.

Such a network of 3D interconnections can be implemented in complex electromagnetic systems. For example, radars include complex mechanical, electronic, and electromagnetic systems. Radar systems may include different subsystems. These subsystems may be composed of different components. For instance, a radar antenna may be configured to act as an interface between the radar system and free space through which radio waves may be transmitted and received. For example, a radar system may be used by a vehicle to detect vehicles in other lanes. The antenna may be configured to transduce free space propagation to guided wave propagation during reception and the opposite during transmission. During transmission, the radiated energy may be concentrated into a shaped beam which points in a desired direction in space. During reception, the antenna collects the energy contained in the echo signal and delivers it to a receiver. The antenna and all or a subset of associated components of the radar system may be integrated into a functional unit by stacking layers as described with respect to FIGS. 3A, 3B, 3C, and 3D to form a network of 3D electromagnetic signal interconnections to implement functionality of the different components of the radar system. Antenna systems may utilize 3D interconnections, including SWGA antennas.

This technology of developing an apparatus on the structure of layers as described above can also be used microwave ovens, satellite communications, high speed routers and cabling, and antenna systems, among others. An SWGA antenna may benefit from the use of PWTL technology. A given application may determine appropriate dimensions and sizes for the radiating apertures and waveguide channels. For instance, some example radar systems may be configured to operate at an electromagnetic wave frequency of 77 Gigahertz (GHz), which corresponds to millimeter (mm) electromagnetic wave length. At this frequency, the radiating apertures and the waveguide channels of the apparatus 300 may be of given dimensions appropriated for the 77 GHz frequency. For, an application operating at frequency that is an order of magnitude lower than the 77 GHz frequency, respective dimensions of the radiating apertures and the waveguide channels of the apparatus 300 may be an order of magnitude larger. Other examples are possible.

IV. Example Slotted Waveguide Array Antenna

Figure 4A:
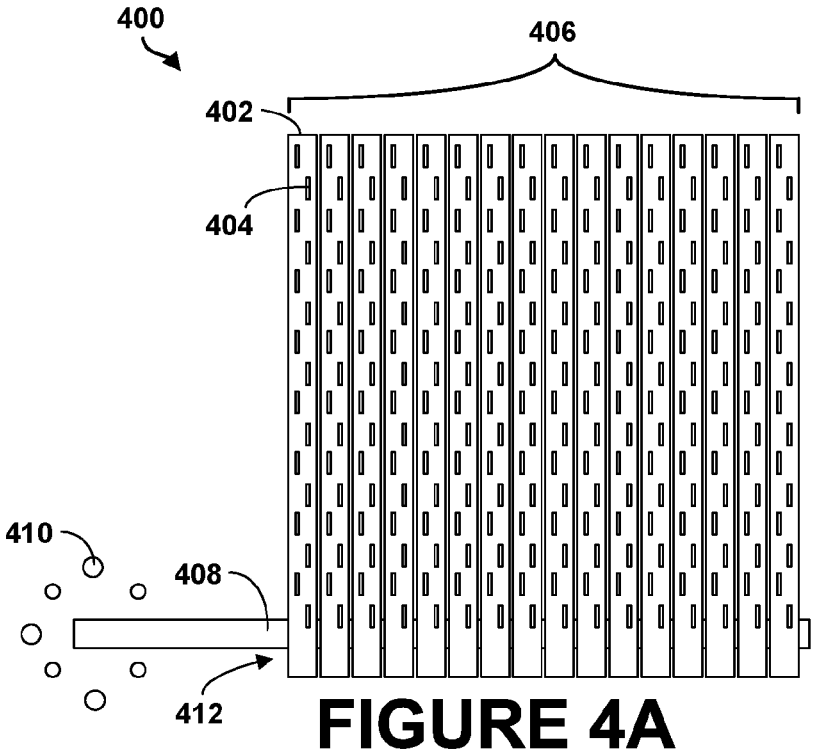
FIG. 4A illustrates a front view of an example slotted waveguide array antenna.
Figure 4B:
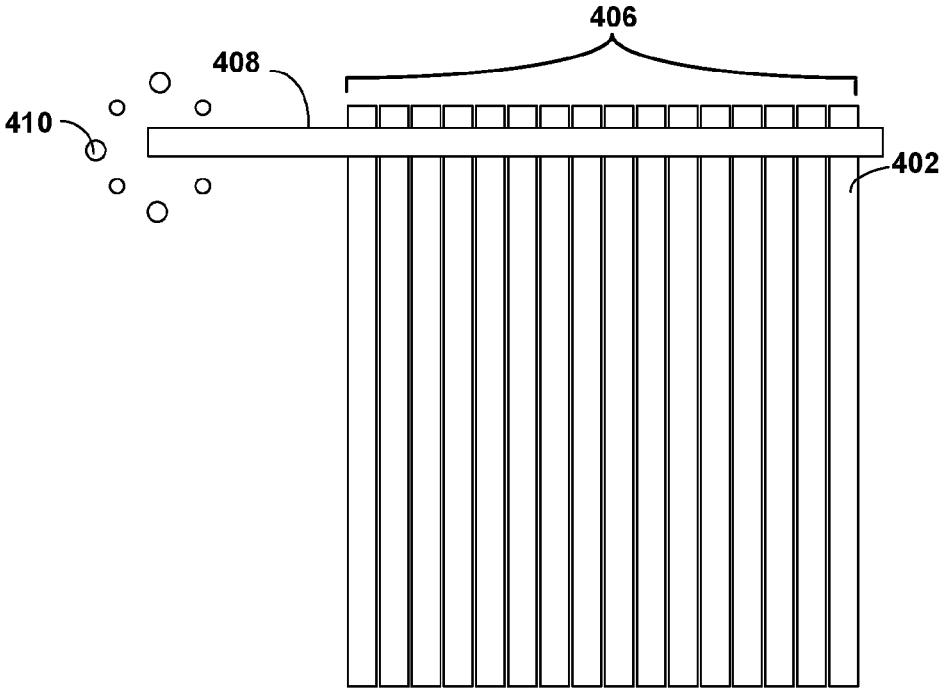
FIG. 4B illustrates a back view of the example slotted waveguide array antenna.

FIGS. 4A-4B illustrate an example SWGA antenna 400, which may be implemented using PWTL technology. For example, PWTL may be used to develop an SWGA antenna using the materials and structural designs as discussed within FIGS. 3A-3D. For illustration purposes, FIG. 4A shows the front view of the example SWGA antenna 400 and FIG. 4B shows the back view of the example SWGA antenna 400.

As depicted in FIGS. 4A-4B, the SWGA antenna 400 of includes multiple slotted waveguides organized in an array 406. Within the array 406, each slotted waveguide 402 may be configured with multiple radiating apertures 104 on one or more surfaces. In addition, FIGS. 4A-4B shows that the SWGA antenna 400 further includes a feed waveguide 408 that may be configured to feed the multiple slotted waveguides 402 of the array 406. The feed waveguide 408 may include a waveguide feed flange 410 as illustrated.

An SWGA antenna may use any number of slotted waveguides, including only a single slotted waveguide. However, in the case that only a single slotted waveguide is used, the radiation pattern of the antenna tend to have a less direct focus of radiation. In order to resolve this issue, slotted waveguides are often aligned in a parallel array, as shown in FIGS. 4A-4B, which improves the overall performance of the antenna. Thus, the SWGA antenna 400 may be built or developed using any number of slotted wave guides 402 including different types of waveguides, such as the slotted waveguide shown in FIG. 1. In the example illustrated by FIGS. 4A-4B, the example SWGA antenna 400 is configured with 16 slotted waveguides in the array. Each of the 16 slotted waveguides includes 16 radiating apertures on a top surface for radiating energy. The slotted waveguides are arranged in a way that all of the radiating apertures of each slotted waveguide line up on the same parallel plane. Although FIG. 4A illustrates the SWGA antenna to show open radiating apertures on the surfaces of the slotted waveguides, in some implementations, a SWGA antenna may be protected by microwave transparent material, which may visually obscure the radiating apertures.

As discussed within Figure and FIGS. 3A-3D, the design and development of an SWGA antenna may include using PWTL technology, which may allow the SWGA antenna to operate at a high gain for radar applications and communication. In addition, applying PWTL technology to develop an SWGA antenna may enable the SWGA antenna to function with high precision at low operating frequencies, including the millimeter wave regions. SWGA antennas developed through the use of PWTL technology may lower construction costs, since using PWTL technology may include using PCB materials, such as FR4, Kapton, sheet metals, metal foils, and multilayer lamination technology to traditionally cost prohibitive high gain antennas. As discussed above, developing an SWGA antenna with PWTL technology may allow the transmission and reception high power levels efficiently. Thus, each slotted waveguide 402 used to build the example SWGA antenna 400 may be developed using multi-layer printed circuit board technology or other variations of PWTL technology. Application of PWTL technology may include structuring portions or components of the SWGA antenna with materials, such as FR4 and Kapton laminates.

FIG. 4A depicts the SWGA antenna 400 to include 16 slotted waveguides. Each slotted waveguide 402 is a waveguide that may be used as an antenna in various radar applications and may operate at various frequencies. Different types of waveguides may be used, including the waveguides utilizing the layered structure shown in FIGS. 3A-3D. Furthermore, the slots may be offset, inclined, or a combination of layouts. Similarly, the waveguide channels may be configured as a broadside configuration or located on the short edges of the waveguide, for example. Thus, a waveguide may be a broadside waveguide or an edge side waveguide within a SWGA antenna.

As illustrated by FIG. 1 and FIG. 4A, each slotted waveguide 402 of the SWGA antenna 400 may include one or more radiating apertures 404 that are configured for emission. For example, the radiating apertures may be roughly the size of about ¼ wavelength in width and ½ of wavelength in length. In some implementations, the radiating apertures may be roughly the size of about 1/10 wavelength in width. Other sizes and shapes of the radiating apertures may exist as well. The spacing of the radiating apertures 404 on a slotted waveguide 402 may be configured as a multiple of the half-waveguide used for transmission and reception. The example shown in FIG. 4A displays the radiating apertures of each slotted waveguide aligning with other slotted waveguides and each having the same size. As illustrated in FIGS. 3A-3D, the radiating apertures of a slotted waveguide may align with waveguide channels and/or radiating apertures of different layers within the structure of the slotted waveguide.

Each radiating aperture 404 may be positioned on the surface a slotted waveguide to allow a small amount of energy to radiate. The radiation may be useful in radar applications or other high frequency systems. As illustrated by FIGS. 3A-3D, the lot impedance and resonant behaviour for a single radiating aperture may be dependent on radiating aperture placement and size. Each radiating aperture could be independently fed with a voltage source across the radiating aperture or from receiving energy from a feed waveguide. Additionally, the geometrical layout of the radiating apertures on a slotted wave guide may affect the gain of the antenna. In some instances, the radiating apertures may be configured to form a high gain antenna that is highly directional in the plane of the antenna. Similarly, the position, shape, and orientation of the radiating apertures 104 on a slotted waveguide 402 may determine how (or if) the slotted waveguide 402 causes radiation. Within a slotted waveguide array antenna 400, radiation occurs when the currents must "go around" the radiating apertures in order to continue on the current's desired direction.

FIG. 4A further depicts a feed waveguide connected to the lower portion of the slotted waveguides of the antenna array 406. As illustrated, the feed waveguide is connected to each slotted waveguide at a perpendicular intersection on the same plane. In other examples, the feed waveguide may be connected to the antenna array at a different position or angle. Further, the feed waveguide may be coupled to only a portion of the slotted waveguides within the antenna array. A feed waveguide within a SWGA antenna may be configured to provide energy to multiple slotted waveguides within the antenna array, similar to a pipe sending water to a shower head that distributes the water through many radiating apertures simultaneously. The feed waveguide may include one or more radiating apertures to connect to the slotted waveguides of the antenna array. Through the radiating apertures and/or through-holes, the feed waveguide may be configured to feed the slotted waveguides. In some implementations, the SWGA antenna may involve multiple feed waveguides. The feed waveguides may be in series and/or parallel (Corporate) feed configuration. A combination of layouts is also possible as well.

FIG. 4A also depicts the feed waveguide including a flange 410 on the end that extends away from the antenna array. As discussed in FIGS. 3A-3D, a flange 410 may be a connector for joining sections of a waveguide. Similar to a pipe flange, the flange 410 may have a connecting face that is square, circular, rectangular, or another shape. Furthermore, the example illustrates an asymmetrical series feed configuration 412, but may be reconfigured in other examples in the middle to feed from the center or moved to other convenient locations within the plane. Similarly, the SWGA antenna may use a corporate feed or a hybrid of series feed and corporate feed configurations.

For illustration purposes, FIG. 4B displays the example SWGA antenna 400 of FIG. 4A from a back view. FIG. 4B depicts the feed waveguide attached to each of the back of every slotted waveguide within the array 406. In the example illustrated by FIG. 4B, the feed waveguide is connected to the upper portion of the antenna array. In other implementations, the feed waveguide may be coupled to the slotted waveguides at a different position or angle.

In some implementations, a SWGA antenna may be developed using multilayer photolithographic imaging, chemical etching, and/or routing processes previously discussed. In one example, the slotted waveguides of an SWGA antenna may include multiple layers of PCB, such as a thick FR4 layer on one layer, parallel channel channels routed with a thin wall in between. In addition, a SWGA antenna may be built using multilayer foils with stamped metal in middle to make channels and using channels as waveguides.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims, along with the full scope of equivalents to which such claims are entitled. It is also to be understood that the terminology used herein is for the purpose of describing particular embodiments only, and is not intended to be limiting.

What is claimed is:

1. An apparatus comprising:

an antenna array including a plurality of radiating waveguides that comprise a plurality of layers including at least a first layer and a second layer, wherein the first layer includes a first conducting layer coupled to a first dielectric layer via a conducting adhesive layer, wherein the first conducting layer includes a first set of radiating apertures and the first dielectric layer includes a first set of waveguide channels, wherein the second layer is coupled to the first dielectric layer via a conducting adhesive layer and includes a second dielectric layer coupled between a second conducting layer and a third conducting layer via given conducting adhesive layers, wherein the second conducting layer includes a second set of radiating apertures and the second dielectric layer includes a second set of waveguide channels, wherein the second set of radiating apertures of the second conducting layer are offset at least in part with respective waveguide channels of the second set of waveguide channels, and the first set of radiating apertures of the first conducting layer are offset at least in part with respective waveguide channels of the first waveguide channels, wherein the first set of waveguide channels includes more waveguide channels than the second set of waveguide channels, and wherein the first set of waveguide channels are oriented in a parallel direction as the second set of waveguide channels; and at least one feed waveguide coupled to the antenna array, wherein the at least one feed waveguide is configured to feed the plurality of radiating waveguides, and wherein the at least one feed waveguide includes an input on an end extended away from the antenna array configured to receive input to feed the plurality of radiating waveguides.

2. The apparatus of claim 1, wherein the at least one feed waveguide includes a flange on the input.

3. The apparatus of claim 1, wherein the first conducting layer, the second conducting layer, and the third conducting layer comprise FR4 or Kapton laminate.

4. The apparatus of claim 1, wherein the at least one feed waveguide is configured in a series feed configuration.

5. The apparatus of claim 1, wherein the plurality of radiating waveguides are configured to transmit millimeter electromagnetic waves.

6. The apparatus of claim 1, wherein the plurality of radiating waveguides are configured to radiate electromagnetic waves in three-dimensions.

* * * * *